US006855900B1

(12) United States Patent
Urushibata

(10) Patent No.: US 6,855,900 B1
(45) Date of Patent: Feb. 15, 2005

(54) CONTACT SPRING

(75) Inventor: Akimitsu Urushibata, Shizuoka (JP)

(73) Assignee: Fuji Electronic Industries, Ltd., Shizuoka (JP)

( * ) Notice: Subject to any disclaimer, the term of this patent is extended or adjusted under 35 U.S.C. 154(b) by 0 days.

(21) Appl. No.: 10/808,980

(22) Filed: Mar. 25, 2004

(30) Foreign Application Priority Data

Sep. 8, 2003 (JP) ..... 2003-315117

(51) Int. Cl.[7] ..... H01H 5/30
(52) U.S. Cl. ..... 200/406; 200/516
(58) Field of Search ..... 200/5 A, 406, 200/512–517, 341, 345

(56) References Cited

U.S. PATENT DOCUMENTS

| | | | | |
|---|---|---|---|---|
| 4,194,105 A | * | 3/1980 | Hodges | 200/517 |
| 4,195,210 A | | 3/1980 | Pounds et al. | |
| 4,207,448 A | * | 6/1980 | Furusawa et al. | 200/516 |
| 4,476,355 A | | 10/1984 | Mital | |
| 6,271,491 B1 | * | 8/2001 | Ono et al. | 200/520 |
| 6,423,918 B1 | | 7/2002 | King et al. | |
| 6,518,527 B2 | | 2/2003 | Watanabe et al. | |
| 6,563,068 B2 | * | 5/2003 | Yamagata et al. | 200/406 |
| 6,683,265 B2 | * | 1/2004 | Masuda | 200/406 |
| 6,700,085 B2 | * | 3/2004 | Teruyama et al. | 200/406 |
| 6,756,554 B1 | * | 6/2004 | Hu | 200/406 |

FOREIGN PATENT DOCUMENTS

| | | |
|---|---|---|
| JP | 2000-322974 | 11/2000 |
| JP | 2001-216865 | 8/2001 |

* cited by examiner

*Primary Examiner*—Michael A. Friedhofer
(74) *Attorney, Agent, or Firm*—Flynn, Thiel, Boutell & Tanis, P.C.

(57) ABSTRACT

There is provided a contact spring in a small-sized push-button switch capable of lessening contact obstacle between contacts caused by fine dust, and reducing variation in load characteristics even if heat is applied thereto or the switch is repetitively operated. The contact spring in the switch for allowing a movable contact provided at an inner side of a movable contact spring to contact or break off the contact with an opposed fixed contact so as to render the movable contact and the fixed contact to be in one of an electrically on or off state, wherein multiple movable contacts are formed by protruding a material of the movable contact spring by a thickness of not more than two thirds of a thickness of the movable contact spring on a circumference about a central portion of the movable contact spring and positioned at an equal central angle relative to the center of the movable contact spring in a direction from an outside to an inner side of the movable contact spring by means of half-cut working while forming a peripheral edge of a protruded contact surface in a sharp blade-shape.

3 Claims, 2 Drawing Sheets

CONTACT SPRING

FIELD OF THE INVENTION

The invention relates to an improvement of a contact spring, which is operable by click action (hereinafter simply referred to as contact spring), for use in a small-sized push-button switch.

The contact spring of this type is built in a small-sized push-button switch of electric equipment or electronic equipment such as audio equipment, video equipment, communication equipment such as a portable telephone, measuring equipment and the like. The small-sized push-button switch is configured in accordance with the use thereof as a box type wherein a single or plural contact springs are built in a box or a sheet type wherein many contact springs such as push-button switches of a portable telephone are built in a sheet (FPC pattern sheet).

The movable contact spring is dome-shaped and configured such that a movable contact provided at an inner part thereof is allowed to contact a fixed contact facing the movable contact or to break off the contact with the fixed contact so as to render the movable contact and the fixed contact to be in an electrically on or off state. When a pushing operation for switching purpose is started, the dome-shaped movable contact spring is reversed owing to the click action function and is switched from an off state to an on state, while when the pushing operation is released or finished, it is returned from the on state to the off state.

Patent Reference, i.e. JP-A 2000-322974 discloses that when a push-button switch is operated on an FPC pattern sheet, a movable contact or dome-shaped movable contact spring is shaped as a semispherical protrusion and an apex of the semispherical protrusion is allowed to contact or break off the contact with a fixed contact by point contact so as to prevent a conduction obstacle caused by fine dust. Although the conduction obstacle can be overcome by such a configuration, parts for working a convex of a mold serving as a production facility (press bending working) are prone to wear our, frequent maintenance thereof has been needed.

Further, when the contact spring is allowed to contact or breaks off the fixed contact of the FPC copper foil pattern, the semi-spherical protrusion of the movable contact falls in the copper foil pattern during the repetitive operations of the contact spring, resulting in the occurrence of variations in stroke and load characteristics. Further, there occurred the problem that working strain remains in a product (dome-shaped contact spring) in the convex working (press bending working) of the dome-shaped protrusion, and this strain is removed when heat is applied after reflow soldering working to largely vary the load characteristics.

SUMMARY OF THE INVENTION

Accordingly, it is an object of the invention to provide a contact spring in a small-sized push-button switch which is devised in a contact shape so as to lessen contact obstacle between contacts caused by fine dust, to reduce the variation in load characteristics even if the switch is repetitively operated, and to reduce switch properties even if heat is applied upon completion of a reflow soldering step.

In view of the above object, The contact spring in the switch for allowing a movable contact provided at an inner side of a movable contact spring to contact or break off the contact with an opposed fixed contact so as to render the movable contact and the fixed contact to be in one of an electrically on or off state, wherein multiple movable contacts are formed by protruding a material of the movable contact spring by a thickness of not more than two thirds of a thickness of the movable contact spring on a circumference about a central portion of the movable contact spring and positioned at an equal central angle relative to the center of the movable contact spring in a direction from an outside to an inner side of the movable contact spring by means of half-cut working while forming a peripheral edge of a protruded contact surface in a sharp blade-shape.

The movable contacts are formed on a circumference about a central portion of the movable contact spring in the number of four in total and positioned at a central angle of 90° relative to the center of the movable contact spring.

The contact surface of the movable contact is formed as a flat surface or a concave surface close to the flat surface.

The following effects can be obtained by the invention. Since plural movable contacts are formed by half-cut working, working strain after working is reduced, different from normal bending working or squeeze working, and click action is not influenced by working strain and hence the movable contact is stabilized, and variation in properties of the movable contact caused by heat after working is reduced. Further, since the mass-production of the dome-shaped contact spring is not made by convex working (press bending working) but by half-cut working (semi-shearing working), a mold is less worn out and the frequent maintenance of the mold is not necessary.

Since the movable contact is formed by the material of the movable contact spring in a thickness of not more than two thirds of a thickness of the movable contact spring by half-cut working, and a portion of the movable contact having the thickness of not less than one thirds within the thickness of the material of two thirds remains continuously on the entire movable contact spring, strength is hardly lowered and spring properties are hardly varied at the portion of each movable contact, intended load characteristics (click action characteristic) can be obtained. Since the peripheral edge of each of the multiple movable contacts is formed as an acute blade-shape, even if dust enters between the movable contact 4 and the fixed contact 5, if it is fine dust, it is crushed by the acute blade-shaped peripheral edge of the movable contact, thereby preventing contact obstacle in advance and a stable switching operation can be expected.

If the contact springs are formed about a central portion of the movable contact spring in the number of four in total at the central angle of 90°, even if eccentric load acts on the dome-shaped movable contact spring, the movable contact close to a point on which the eccentric load acts is brought into contact with the fixed contact, a stable switching operation can be secured for a long period of time even if the eccentric load acts on the movable contact spring in all the directions. Further, since the surface of the movable contact facing the fixed contact is formed as a flat surface or a concave surface close to the flat surface, even if the movable contact is repetitively operated, it falls in a copper foil pattern as the fixed contact to some extent but it does not fall in the copper foil to the level deeper than some extent, variations in stroke and in load characteristics can be reduced.

PREFERRED EMBODIMENT OF THE INVENTION

Figure 1:
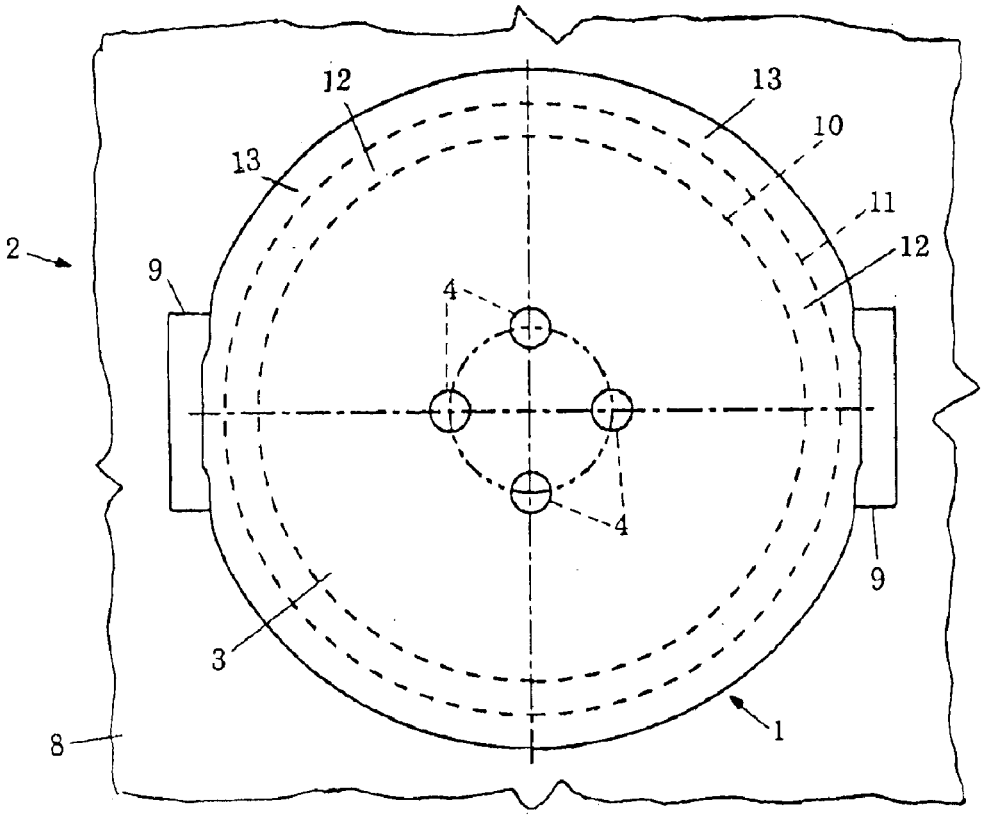
FIG. 1 is a plan view showing a state where a contact spring is built in a switch.

FIGS. 1 to 5 show a state where a contact spring 1 of the invention is built in a small-sized push-button switch 2. The switch allows the movable contact 4 to contact or break off the contact with an opposed fixed contact 5 to render the movable contact 4 and the fixed contact 5 to be in one of an electrically on or off state. The movable contact spring 3 contacts a conductive pattern 9 of a substrate 8 at a peripheral end along the diametrical line thereof. The fixed contact 5 is formed on the upper surface of the substrate 8, for example, by a part of the conductive pattern 9 and faces the movable contact 4 of the movable contact spring 3 at the inner side thereof. The conductive pattern 9 is formed of a copper foil on the upper surface of the substrate 8, normally by print wiring technique.

The contact spring 1 of the invention is configured by the movable contact spring 3 set forth above. The movable contact spring 3 is formed in a spherical dome-shape by a spring member made of discoid stainless steel (SUS301CSP-H) on the order of 0.06 mm in thickness and 5.0 mm in diameter, and has two circular bent portions 10, 11 at the periphery thereof. The movable contact spring 3 is formed in a spherical surface which is elastically reversibly deformed at the center thereof while demarcating the bent portion 10 at the center side, and has a skirt part 12 having a conical surface and formed between the bent portions 10 and 11, and also formed in a skirt part 13 having a conical surface and formed at the peripheral side of the bent portion 1.outside the bent portion 11 and having an apex which is different from an apex of the cone of the conical skirt part 12.

The movable contact spring 3 has multiple movable contacts 4 provided on a circumference having a diameter on the order of 1.2 mm about a center of the dome-shaped inner side surface thereof and positioned at an equal central angle relative to the center of the movable contact 4. In this embodiment, the movable contacts 4 are formed on a circumference having a diameter on the order of 1.2 mm about a central portion of the movable contact spring in the number of four in total and positioned at a central angle of 90°. Each movable contact 4 has a circular shape having a diameter on the order of 0.3 mm and it is formed by protruding a spring member of the movable contact spring 3 by the thickness of about two thirds of the spring member, e.g. 0.02 mm in the direction from the outer side to the inner side of the spring member by half-cut working (semi-shearing) by use of a pressing machine. The limitation of the thickness of each movable contact 4 is required to maintain the strength of the spring member of the movable contact spring 3 and to secure a given click action function without punching the movable contact 4 from the movable contact spring 3.

Since the plural movable contacts 4 are formed by half cut working as set forth above, different from normal bending working and squeeze working, there is less working strain remaining on the movable contact spring 3 after working and the click action is not influenced by working strain, and hence the movable contact 4 is stabilized. Further, variation in properties of the movable contact 4 caused by heat after working is reduced. Since the movable contact 4 is formed in the thickness of not more than two thirds of a material of the movable contact spring 3 by half-cut working, and the portion of the movable contact 4 having the thickness of not less than one thirds within the thickness of the material of two thirds remains continuously on the movable contact spring 3, the strength is hardly lowered and spring characteristics is hardly varied at the portion of each movable contact 4, so that intended load characteristics (click action characteristic) can be obtained. Still further, in the course of the mass-production of the contact spring 1, the contact spring 1 is subjected not to protrusion working (press bending working) but to half-cut working (half-shearing), resulting in advantage that a mold is less worn out and frequent maintenance thereof is not necessary.

Figure 4:
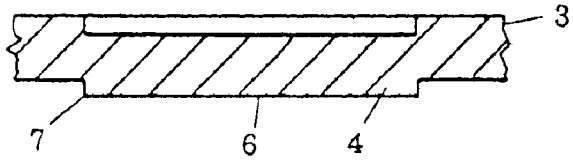
FIG. 4 is an enlarged sectional view of a portion of the movable contact of the contact spring.
Figure 5:
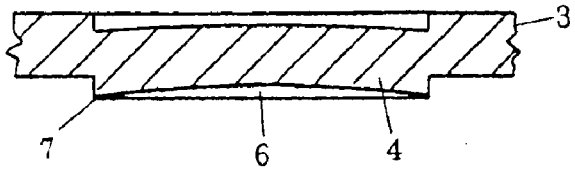
FIG. 5 is an enlarged sectional view of a portion of another movable contact of the contact spring.

Since the portion protruded by half-cut working (semi-shearing working), namely, a peripheral edge 7 of the movable contact 4 is a shearing surface, it becomes acute blade-shaped close to a cross section of 90° and a contact surface 6 surrounded by the peripheral edge 7 is configured that it faces the fixed contact 5 and has a flat surface as shown in FIG. 4, or a concave surface close to the flat surface as shown in FIG. 5. If the contact surface 6 is formed in a concave surface, the cross section thereof is slightly smaller than 90° and becomes more acute blade-shaped.

Figure 6:
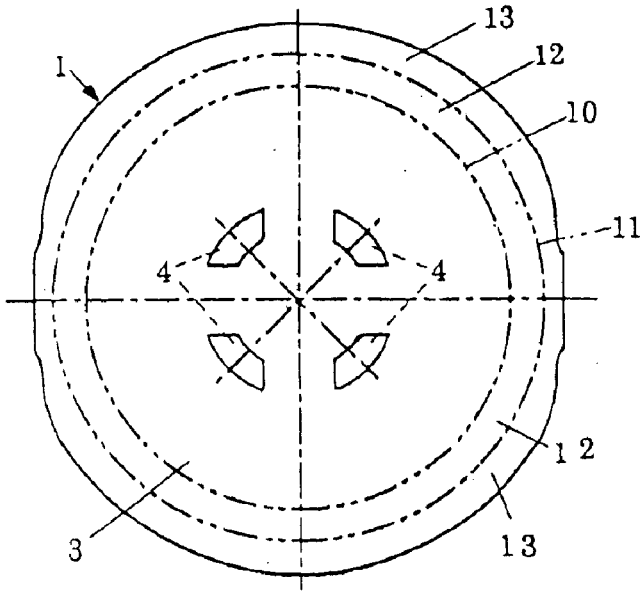
FIG. 6 is a plan view of another contact spring.

Further, the movable contact 4 is configured that it has a circular shape on the order of 0.3 mm in diameter as shown in FIG. 1, or a shape obtained by splitting a circular belt into four part as shown in FIG. 6, or an elliptical, an oval shape, a rectangular shape, a square shape, and other polygonal shapes. Meanwhile, the contact spring 1 shown in FIG. 6 is smaller than the contact springs 1 shown in FIGS. 1 and 3, and has a diameter on the order of 4.0 mm.

Figure 2:
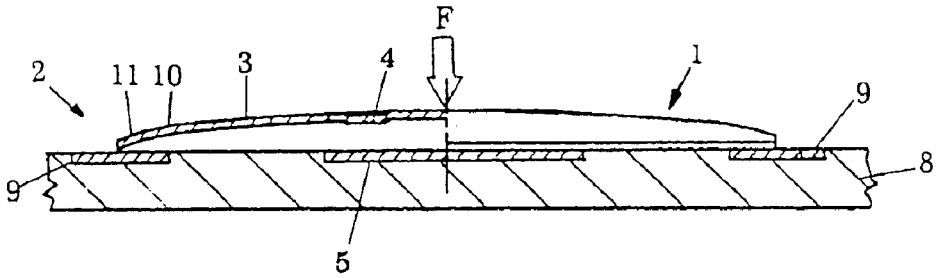
FIG. 2 is a partially broken side view of the contact spring when the contact spring is not reversed in a state where the contact spring is built in the switch.
Figure 3:
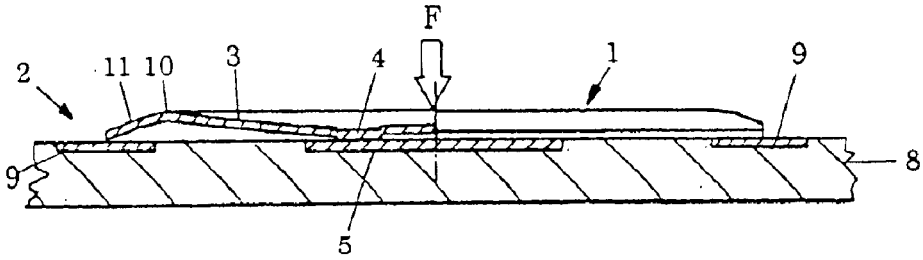
FIG. 3 is a partially broken side view of the contact spring when the contact spring is reversed in a state where the contact spring is built in the switch.
Figure 7:
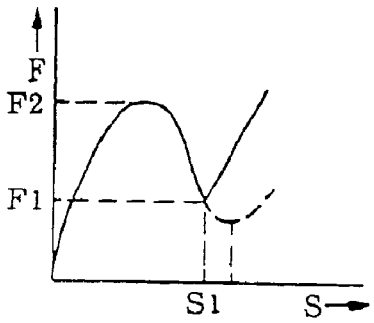
FIG. 7 is a graph showing characteristics between a stroke and an operating load of the contact spring.

FIG. 7 is a graph showing spring properties of the contact spring 1, namely, a stroke S (axis of abscissas [mm]) and an operating load F (axis of ordinates [gf]) of the contact spring 3. As shown in FIGS. 2 and 3, if an operator pushes the center of the contact spring 1 downward to act the operating load F on the central part of the contact spring 3 in the direction of a normal line, the stroke S of the movable contact part 4 is increased substantially in proportion to the operating load F at the first stage. However, if the operating load F exceeds an operating load F1 and reach an operating load F2, the movable contact 4 is reversed in a warping direction by the click action as shown in FIG. 3, and hence the movable contact 4 is moved in the direction of the stroke S even with the operating load F which is smaller than the operating load F2 which has acted on the movable contact spring 3 so far.

When the movable contact 4 is reversed in a warping direction, the movable contact spring 3 bends step by step at the bent portions 10 and 11 serving as bending lines and it is elastically deformed at the spherical portion so that the movable contact 4 is reversed in a warping direction to become in a flat state. If the operating load F still acts on the movable contact spring 3 even thereafter, the movable contact 4 of the movable contact spring 3 reaches the stroke S1 to be brought into contact with the corresponding fixed contact 5. At this time, the movable contact 4 of the movable contact spring 3 and the fixed contact 5 are rendered in an electrically on state. When the movable contact spring 3 is reversed, the skirt portions 12 and 13 are not reversed, but they contact the conductive pattern 9 under a given contact pressure so that they are electrically conductive.

Since the movable contacts 4 are formed on the central portion of the movable contact spring 3 in the number of four, even if the operating load F acts on the movable contact spring 3 at the eccentric position, or in a normal line at some angles during the switching operation set forth above, the movable contact 4 which is close to the acting point of the operating load F is brought into contact with the fixed contact 5, a stable switching operation can be secured even if eccentric load acts on the movable contact spring 3 in all directions.

In the on state set forth above, the contact surface 6 of the movable contact 4 becomes in a line contact at an annular blade-shaped portion to contact the surface of the fixed contact 5. Accordingly, even if fine dust is adhered between the contact surface 6 of the movable contact 4 and the surface of the fixed contact 5, the bent portion or contact surface 10 crushes such fine dust, thereby preventing contact obstacle. Accordingly, a stable switching operation for a long period of time can be expected. Further, since the contact surface 6 of the movable contact 4 facing the fixed contact 5 is formed in a flat surface or a concave surface close to the flat surface, if the movable contact 4 is repetitively operated, the contact surface 6 falls in the fixed contact 5 to some extent until reaching certain number of operations, but it does not fall in the fixed contact to the level deeper than the some extent, so that variations in stroke and load characteristics are reduced.

The operating load F corresponding to the stroke S1 is changed to the operating load F1 having a small force. If the small operating load F1 is given out when an operator stops pushing of the center of the contact spring 1, the movable contact spring 3 is reversed again in the opposed direction so that the movable contact spring 3 returns to a former state, and it is rendered in an electrically off state.

Although the contact spring 1 of the invention is built in the small-sized push-button switch 2, the switch 2 is configured, depending on the use thereof, as an independent box type switch or as multigroup switch on an FPC pattern such as a push-button switch of a portable telephone or a TV controller (ten key switch, function key switch).

What is claimed is:

1. A contact spring in a switch for allowing a movable contact provided at an inner side of a movable contact spring to contact or break off the contact with an opposed fixed contact so as to render the movable contact and the fixed contact to be in one of an electrically on or off state;

wherein multiple movable contacts are formed by protruding a material of the movable contact spring by a thickness of not more than two thirds of a thickness of the movable contact spring on a circumference about a central portion of the movable contact spring and positioned at an equal central angle relative to the center of the movable contact spring in a direction from an outside to an inner side of the movable contact spring by means of half-cut working while forming a peripheral edge of a protruded contact surface in a sharp blade-shape.

2. The contact spring according to claim 1, wherein the movable contacts are formed on a circumference about a central portion of the movable contact spring in the number of four in total and positioned at a central angle of 90° relative to the center of the movable contact spring.

3. The contact spring according to claim 1, wherein the contact surface of the movable contact is formed as a flat surface or a concave surface close to the flat surface.

* * * * *